US007523886B2

(12) United States Patent
Kim

(10) Patent No.: US 7,523,886 B2
(45) Date of Patent: Apr. 28, 2009

(54) UNCOILER APPARATUS

(75) Inventor: Jong-Cheol Kim, Jeollabuk-do (KR)

(73) Assignee: Hyundai Motor Company, Seoul (KR)

( * ) Notice: Subject to any disclaimer, the term of this patent is extended or adjusted under 35 U.S.C. 154(b) by 243 days.

(21) Appl. No.: 11/648,816

(22) Filed: Dec. 28, 2006

(65) Prior Publication Data

US 2008/0111019 A1 May 15, 2008

(30) Foreign Application Priority Data

Nov. 10, 2006 (KR) ..... 10-2006-0110950

(51) Int. Cl.
*B65H 75/24* (2006.01)

(52) U.S. Cl. ..... 242/571.3; 242/576.1; 242/597.3

(58) Field of Classification Search ..... 242/571, 242/571.3, 573.8, 576.1, 597.3, 563; 279/2.06
See application file for complete search history.

(56) References Cited

U.S. PATENT DOCUMENTS 3,396,918 A * 8/1968 Adamson et al. ..... 242/570
3,878,999 A * 4/1975 Daves ..... 242/413.4
4,218,029 A * 8/1980 Schwenzfeier et al. ... 242/530.3
6,886,822 B2 * 5/2005 Kawakami ..... 269/309

FOREIGN PATENT DOCUMENTS

JP 57058919 4/1982
JP 61219423 9/1986
JP 2300050 12/1990

* cited by examiner

*Primary Examiner*—Sang Kim
(74) *Attorney, Agent, or Firm*—Morgan, Lewis & Bockius LLP

(57) ABSTRACT

The present invention provides an uncoiler apparatus capable of minimizing a waste amount of the total amount of coil, by reducing the damage to the surface of the coil caused by line contact between the coil and a drum when the drum expands to clamp the coil. The invention provides an uncoiler apparatus which includes: a stationary drum; a plurality of pressure cells rotatably disposed at an outer periphery of the stationary drum, the pressure cells being spaced radially along the periphery of the stationary drum and capable of individually expanding and contracting; a pressure applying unit that provides pressure to the plurality of pressure cells; a pressure regulator that regulates the amount of pressure supplied to each of the plurality of pressure cells by the pressure applying unit; a load detector that detects load of a coil wound about the plurality of pressure cells; and a controller that controls the pressure regulator on the basis of the load of the coil detected by the load detector to control the pressure supplied to the plurality pressure cells by the pressure applying unit.

13 Claims, 3 Drawing Sheets

UNCOILER APPARATUS

CROSS-REFERENCE TO RELATED APPLICATIONS

The present application is based on, and claims priority from, Korean application Serial Number 10-2006-0110950 filed on Nov. 10, 2006, application is hereby incorporated by reference herein in its entirety.

FIELD OF THE INVENTION

The present invention relates to an uncoiler apparatus capable of preventing damage to a contact portion of a coil wound on a drum.

BACKGROUND OF THE INVENTION

Generally, a coiler refers to an apparatus that winds a predetermined amount of coil corresponding to a sheet-shaped plate and an uncoiler refers to an apparatus that unwinds the wound coil contrary to the coiler.

In order to easily wrap and unwrap a coil, known uncoiler apparatus utilize a drum that applies outward pressure to the inner surface of the coil. As the coil is wound on the drum, the coil is clamped by the outward pressure of the drum about which it is placed. When the coil is pulled, the coil rotates with and is unwound from the drum. When the drum stops rotating, the clamping force of the drum prevents the coil from unwinding further.

Such coiler apparatus ensure positive engagement through application of a single, high clamping force. Because a single, fixed clamping force is applied in all cases, the clamping force in individual applications tends to be higher than necessary.

Excessive pressure applied by the drum on the coil damages the part of the coil in contact with the drum at the inner periphery of the coil. Because of the damage to the surface of the coil, a significant amount (e.g. 20%) of the total amount of the coil is wasted.

What is needed is an uncoiler apparatus that allows for coiling and uncoiling while overcoming the above-mentioned disadvantages.

SUMMARY OF THE INVENTION

The present invention provides an uncoiler apparatus capable of minimizing waste and destruction of coil by reducing the damage to the surface of the coil caused by the line contact between the coil and the drum when the drum expands to clamp the coil.

The present invention provides an uncoiler apparatus which includes: a stationary drum; a plurality of pressure cells rotatably disposed at an outer periphery of the stationary drum, the pressure cells being spaced radially along the periphery of the stationary drum and capable of individually expanding and contracting; a pressure applying unit that provides pressure to the plurality of pressure cells; a pressure regulator that regulates the amount of pressure supplied to each of the plurality of pressure cells by the pressure applying unit; a load detector that detects load of a coil wound about the plurality of pressure cells; and a controller that controls the pressure regulator on the basis of the load of the coil detected by the load detector to control the pressure supplied to the plurality pressure cells by the pressure applying unit.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
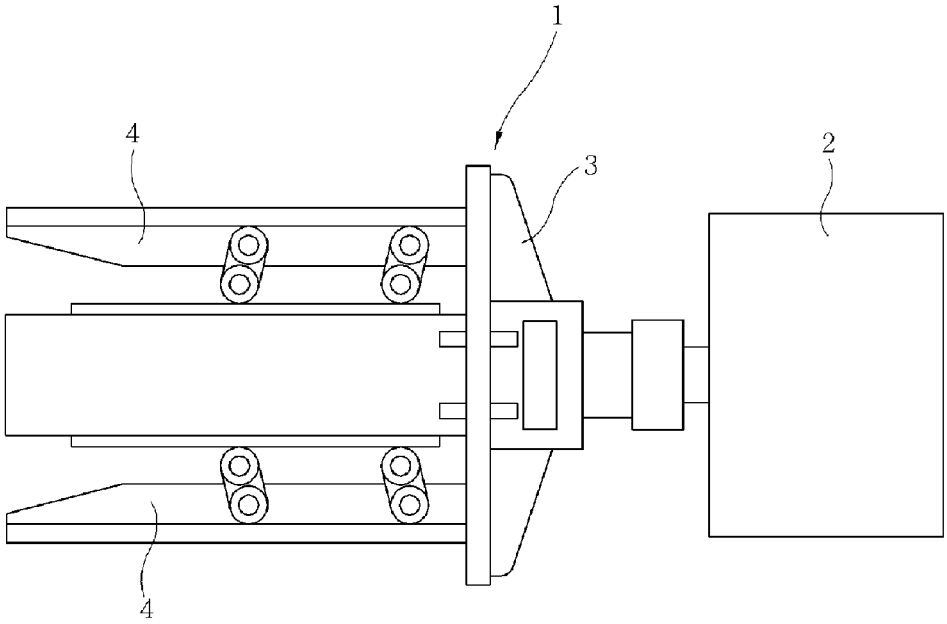
FIG. 1 (Prior Art)
FIG. 1 is a front view of an uncoiler apparatus according to the related art.
Figure 2:
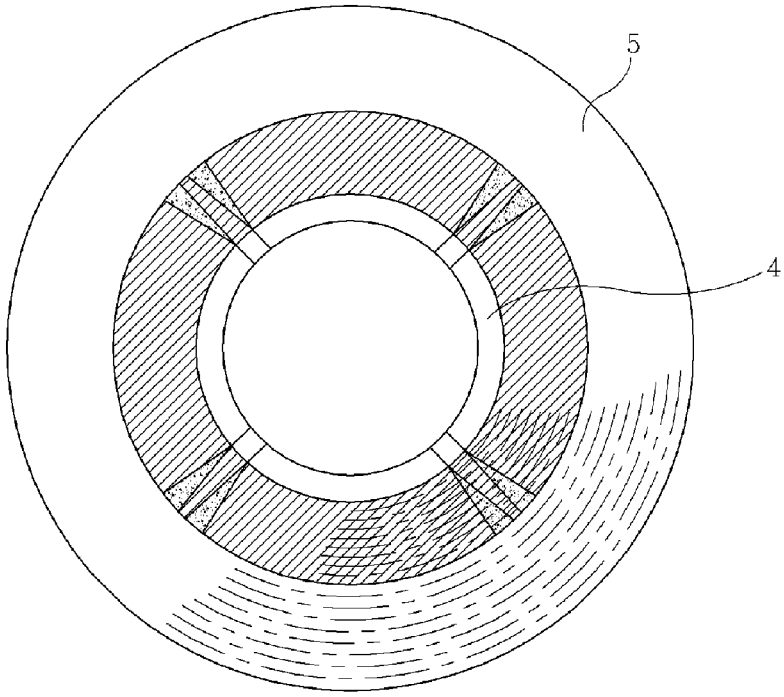
FIG. 2 (Prior Art)
FIG. 2 is a side view of the uncoiler apparatus of FIG. 1.

FIGS. 1 and 2 illustrate a common uncoiler apparatus 1. The uncoiler apparatus includes a body 2 in which a driving means is disposed, a rotator 3 which is rotatably coupled with body 2 by a means for driving motor, and a plurality of drums 4 which are coupled with rotator 3 and radially expand outward. Drum 4 presses outward against the inner side of coil 5 so as to clamp coil 5, which is wound on the outer side of the drum.

Figure 3:
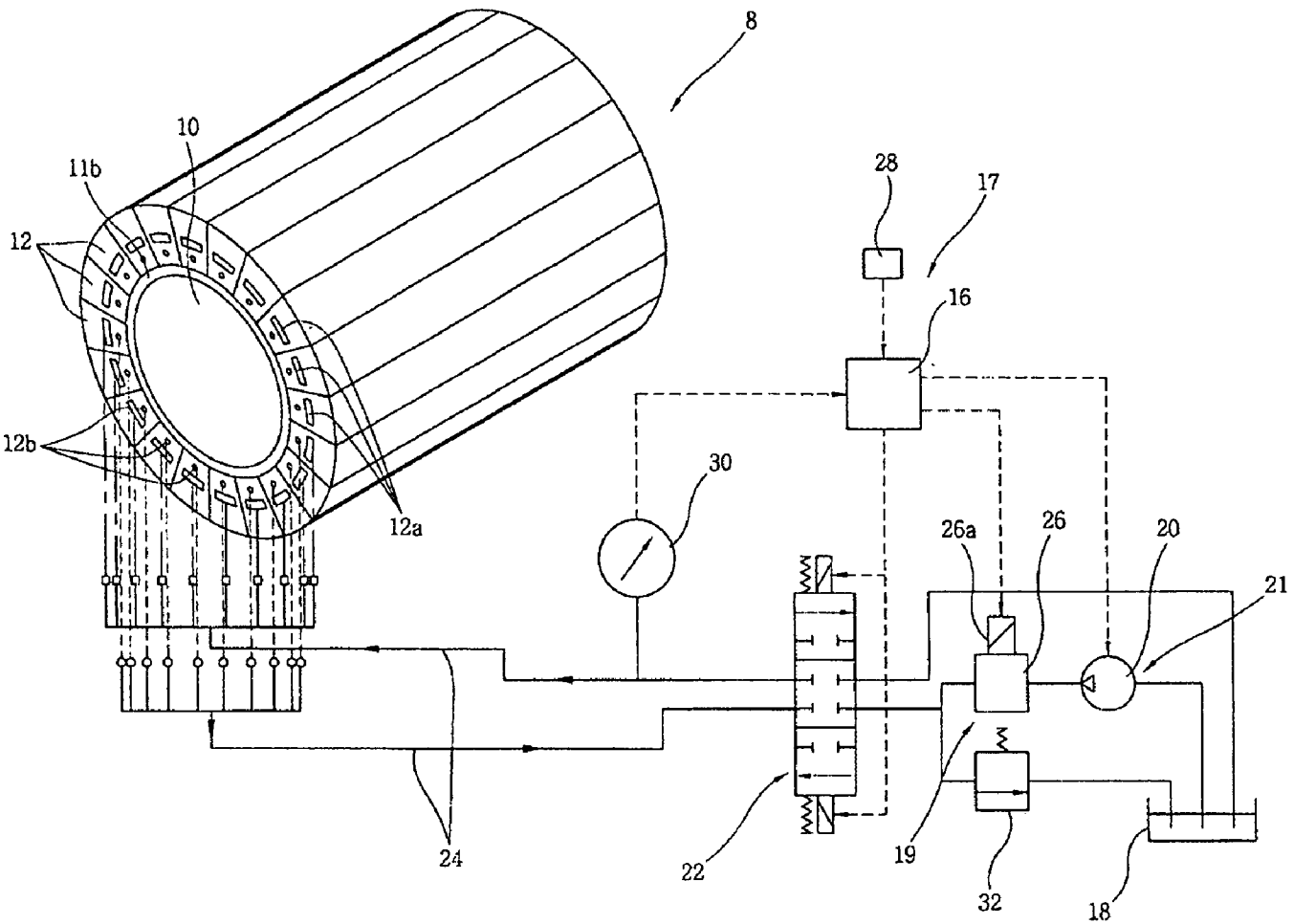
FIG. 3 is a perspective view of an uncoiler apparatus according to the present invention.
Figure 4:
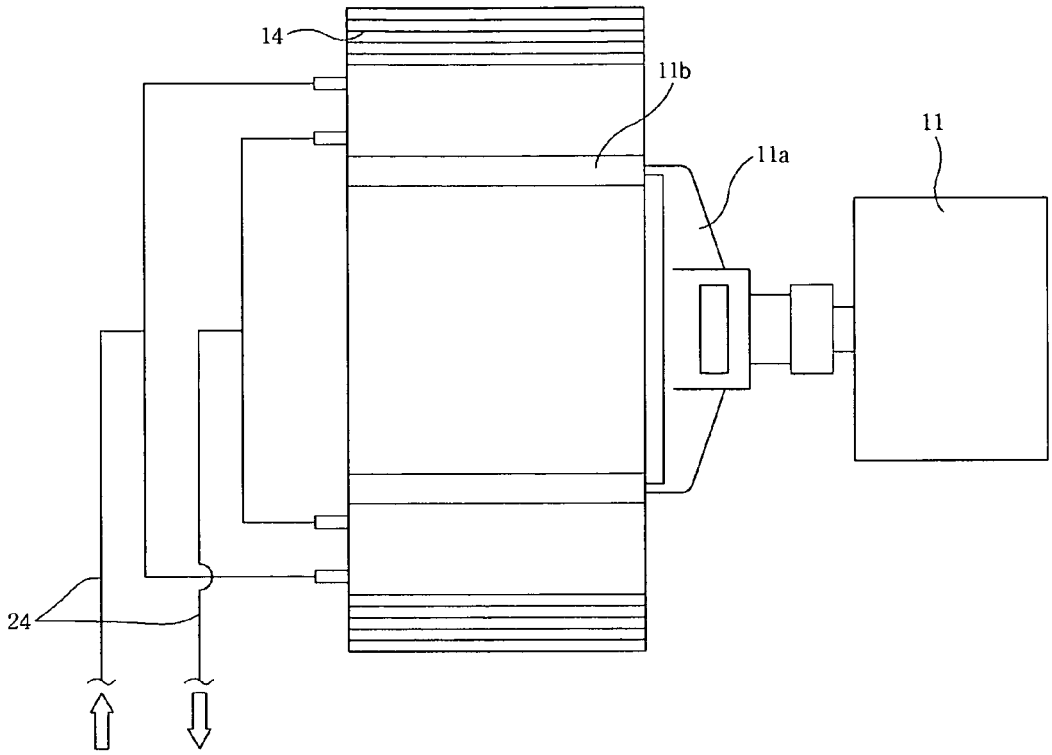
FIG. 4 is a side view of the uncoiler apparatus of FIG. 3.

Turning to FIGS. 3 and 4, an uncoiler apparatus 8 in accordance with the present invention is shown. In the illustrated embodiment, the uncoiler apparatus includes a plurality of pressure or actuator cells 12 rotatably disposed at an outer periphery of a cylindrically stationary drum 10. The hydraulic pressure cells are radially-spaced along the periphery of stationary drum 10 and each pressure cell 12 can expand and contract individually. The pressure cells may be disposed at an outer periphery of the stationary drum with other configurations, including, but not limited to, use of bearings, rotational members, and the like disposed between the pressure cells and stationary drum. The pressure cells may also be spaced along the periphery in any suitable pattern.

In the illustrated embodiment, a hydraulic pressure applying unit 21 provides each of the plurality of hydraulic pressure cells 12 with hydraulic pressure, and a pressure regulator 19 controls the hydraulic pressure by the hydraulic pressure applying unit. The pressure applying unit may be a hydraulic pump or other suitable devices. Controller 16 controls the pressure regulator on the basis of the weight of a coil 14 coiled about drum 10. The weight is detected by a load detector 17. Pressure cells 12 may also be controlled by other means not including hydraulic pressure.

A rotator 11*a* connects a rotary drum 11*b* to driving means 11 disposed at an end of stationary drum 10. The inner periphery of the plurality of hydraulic pressure cells is fixedly supported by the outer periphery of rotary drum 11*b*.

In the illustrated embodiment, each pressure cell 12 is a tube or cylinder composed of a material which can expand and contract in the radial direction of rotary drum 11*b*. The radial direction is defined as being in the direction from the axis of rotation to the periphery of rotary drum 11*b*. In one embodiment, pressure cells 12 are configured to expand and contract in the circumferential direction defined as the direction along the periphery of rotary drum 11*b*. In the illustrated embodiment, pressure cells 12 expand and contract substantially in relation to each other, but the pressure cells may also be configured to expand and contract independently of one another.

When the plurality of hydraulic pressure cells 12 expand, the hydraulic pressure cells mutually adhere to each other to minimize the clearance between rotary drum 11*b* and pressure cells 12 and the clearance between the inner periphery of coil 14 and pressure cells 12.

In the illustrated embodiment, the hydraulic pressure applying unit is composed of a pump 20 which pressurizes a fluid such as oil or water stored in a reservoir tank 18, a flow path conversion valve 22 which regulates the supply and release of the pressurized fluid, and a hydraulic pressure pipeline 24 for supply and return which individually connects flow path conversion valve 22 and the plurality of hydraulic pressure cells 12. In one embodiment, each of the hydraulic pressure cells 12 includes fitting members 12*a* and 12*b* for the supply and return fluid lines to be tightly connected to hydraulic pressure pipeline 24. The flow path conversion valve 22 is formed of a three-way valve which can control supply, return, and neutral modes of hydraulic pressure to hydraulic pressure cells 12. Hydraulic pressure cells 12 may be contracted, expanded, and moved using other configurations and devices including, but not limited to, solenoids, actuators, elastic tabs, and the like.

Pressure regulator 19 is formed of a regulator valve which regulates the amount of hydraulic pressure supplied to hydraulic pressure cell 12 through hydraulic pressure applying unit 21. The regulator valve is designed to regulate the amount of hydraulic pressure by controller 16. In the illustrated embodiment, the pressure regulator is formed of an electronic regulator valve 26 which regulates the amount of hydraulic pressure to be supplied to hydraulic pressure cell 12 through the hydraulic pressure applying unit. Electronic regulator valve 26 includes a solenoid driving unit 26*a* that regulates the amount of hydraulic pressure according to instructions from controller 16.

Load detector 17 is formed of a photo sensor 28 and controller 16. The photo sensor detects the amount of coil 14 wound on the outer periphery of the plurality of hydraulic pressure cells 12 in a non-contact manner. Non-contact denotes the portion of the coil around the pressure cells 12 but not in direct contact with the pressure cells.

Controller 16 includes a calculation circuit which calculates the load or force of coil 14 on the outer periphery of hydraulic pressure cells 12 on the basis of signals from photo sensor 28. Based upon the resulting calculation, the controller regulates the amount of hydraulic pressure that the hydraulic pressure applying unit supplies to the plurality of hydraulic pressure cells. While controlling the operation of the pressure regulator in response to the load of coil 14, controller 16 performs looped feedback control of the amount of hydraulic pressure supplied to hydraulic pressure cells 12 by using a pressure detection sensor 30 disposed in hydraulic pressure pipeline 24. Although the illustrated embodiment employs a photo sensor, pressure detection sensor, and controller, other configurations may be employed to detect the load of coil 14 and adjust the movement and force applied by the plurality of pressure cells.

Electronic regulator valve 26 optionally includes a relief valve 32 at a rear side of the valve to prevent the hydraulic pressure from increasing above a safe level for the regulator and pressure cells.

Hereinafter, operation of the uncoiler apparatus according to the invention will be described in detail.

Driving means 11 rotate rotator 11*a*, which in turn rotates rotary drum 11*b* about stationary drum 10. This winds coil 14 on the outer periphery of each of the plurality of hydraulic pressure cells 12 in accordance with the rotation of rotary drum 11*b*. When coil 14 stops being wound on the outer periphery of hydraulic pressure cells 12, controller 16 controls the hydraulic pressure applying unit and the pressure regulator to provide a proper amount of hydraulic pressure to hydraulic pressure cell 12 so as to minimize the damage to the coil in contact with the pressure cells while maintaining the coil in place. Accordingly, the inner side of coil 14 wound on the outer periphery of hydraulic pressure cell 12 is pressed outward and clamped without unnecessary damage. In this manner, surface contact between the outer periphery of each hydraulic pressure cell 12 and the inner periphery of coil 14 is maintained with minimal line contact force.

Controller 16 simultaneously determines the load of coil 14 on the plurality of hydraulic pressure cells based upon detection signals from photo sensor 28. In response, controller 16 controls solenoid driving unit 26*a* of electronic regulator valve 26 to regulate the amount of hydraulic pressure supplied to the plurality of hydraulic pressure cells through flow path conversion valve 22 and hydraulic pressure pipeline 24.

Controller 16 processes the amount of hydraulic pressure detected by pressure detection sensor 30 to perform feedback control of the hydraulic pressure supplied to the plurality of hydraulic pressure cells thus improving the accuracy and responsiveness of the pressure control function.

As described above, the uncoiler apparatus according to the present invention can clamp the coil to the drum and maintain surface contact with the plurality of hydraulic pressure cells while minimizing damage to the coil. Accordingly, unexpected loss of material can be prevented and the cost of the coiling process decreased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An uncoiler apparatus, comprising:

a stationary drum;

a plurality of pressure cells rotatably disposed at an outer periphery of the stationary drum, the pressure cells being spaced radially along the periphery of the stationary drum and capable of individually expanding and contracting;

a pressure applying unit that provides pressure to the plurality of pressure cells;

a pressure regulator that regulates the amount of pressure supplied to each of the plurality of pressure cells by the pressure applying unit;

a load detector that detects load of a coil wound about the plurality of pressure cells; and a controller that controls the pressure regulator on the basis of the load of the coil detected by the load detector to control the pressure supplied to the plurality pressure cells by the pressure applying unit.

2. The uncoiler apparatus as defined in claim 1, wherein a rotary drum connected to a rotator rotated by a driving means is disposed at an end of the stationary drum; and the inner periphery of the plurality of pressure cells is rotatably supported by the outer periphery of the rotary drum.

3. The uncoiler apparatus as defined in claim 2, wherein each of the plurality of pressure cells is formed of a tube of material configured to expand and contract in the radial direction and circumferential direction of the rotary drum.

4. The uncoiler apparatus as defined in claim 1, wherein the pressure cells are hydraulic pressure cells motivated by application of hydraulic pressure thereto.

5. The uncoiler apparatus as defined in claim 4, wherein the hydraulic pressure applying unit includes:

a pump which pressurizes oil stored in a reservoir tank;

a flow path conversion valve which regulates supply and release of the oil pressurized by the pump; and a hydraulic pressure pipeline for supply and return which individually connects the flow path conversion valve and the plurality of hydraulic pressure cells.

6. The uncoiler apparatus as defined in claim 5, wherein each of the plurality of hydraulic pressure cells include supply and return fitting members to be tightly connected to the hydraulic pressure pipeline for supply and return.

7. The uncoiler apparatus as defined in claim 5, wherein the load detector is formed of a photo sensor which detects the amount of the coil wound on the outer periphery of each of the plurality of hydraulic pressure cells in a non-contact manner, and the controller includes a calculation circuit which calculates the load of the coil wound on the outer periphery of each of the plurality of hydraulic pressure cells on the basis of detection signals from the photo sensor.

8. The uncoiler apparatus as defined in claim 7, wherein when controlling the amount of hydraulic pressure that the hydraulic pressure applying unit supplies to the plurality of hydraulic pressure cells the controller performs feedback control of the hydraulic pressure supplied to each of the plurality of hydraulic pressure cells using a pressure detection sensor disposed in the hydraulic pressure pipeline.

9. The uncoiler apparatus as defined in claim 4, wherein the pressure regulator is formed of an electronic regulator valve which regulates the amount of hydraulic pressure to be supplied to each of the plurality of hydraulic pressure cells through the hydraulic pressure applying unit, and the electronic regulator valve includes a solenoid driving unit which regulates the amount of hydraulic pressure.

10. The uncoiler apparatus defined in claim 1, wherein when controller controls operation of the pressure regulator in accordance with the load of the coil detected by the load detector to control the amount of pressure that the pressure applying unit supplies to the plurality of pressure cells.

11. An uncoiler apparatus, comprising:

a stationary drum;

a plurality of actuator cells in rotational engagement with each other, the plurality of actuator cells being disposed about a periphery of the stationary drum and in rotational communication with the stationary drum;

a load detector that detects a load of a coil wound over the plurality of actuator cells; and an actuator configured to actuate each of the plurality of actuator cells in response to a detection signal from the load detector;

wherein the plurality of actuator cells are configured to individually apply pressure to an inner surface of the coil.

12. The uncoiler apparatus defined in claim 11, wherein the plurality of actuator cells are hydraulic pressure cells.

13. The uncoiler apparatus defined in claim 12, wherein the actuator includes a hydraulic pressure applying unit for applying pressure to the plurality of actuator cells, a pressure regulator for regulating the hydraulic pressure, and a controller for controlling the pressure regulator, whereby the controller includes feedback loop control.

* * * * *